US010731347B2

(12) United States Patent
Parsons et al.

(10) Patent No.: US 10,731,347 B2
(45) Date of Patent: Aug. 4, 2020

(54) VARIABLE SECTION INTERLOCKING STRUCTURAL PANEL

(71) Applicant: LUCAS HOLDINGS (QUEENSLAND) PTY. LTD., Queensland (AU)

(72) Inventors: Arthur Allen Parsons, Queensland (AU); Richard James Lucas, Queensland (AU)

(73) Assignee: LUCAS HOLDINGS (QUEENSLAND) PTY. LTD., Burleigh Heads (AU)

( * ) Notice: Subject to any disclaimer, the term of this patent is extended or adjusted under 35 U.S.C. 154(b) by 0 days.

(21) Appl. No.: 15/756,203

(22) PCT Filed: Aug. 30, 2016

(86) PCT No.: PCT/AU2016/050812
§ 371 (c)(1),
(2) Date: Feb. 28, 2018

(87) PCT Pub. No.: WO2017/035583
PCT Pub. Date: Mar. 9, 2017

(65) Prior Publication Data

US 2018/0266113 A1 Sep. 20, 2018

(30) Foreign Application Priority Data

Aug. 31, 2015 (AU) ..... 2015903545

(51) Int. Cl.
*E04D 3/363* (2006.01)
*E04D 3/30* (2006.01)
*E04D 3/24* (2006.01)

(52) U.S. Cl.
CPC ..... *E04D 3/363* (2013.01); *E04D 3/24* (2013.01); *E04D 3/30* (2013.01)

(58) Field of Classification Search
CPC .. E04D 3/363; E04D 3/24; E04D 3/30; E04D 3/361; E04D 3/3615; E04D 3/3617; E04D 3/362; E04D 3/368
(Continued)

(56) References Cited

U.S. PATENT DOCUMENTS 2,019,379 A * 10/1935 Anderson ..... E06B 9/15 160/235
2,063,159 A * 12/1936 Groove ..... E04C 2/40 428/129
(Continued)

FOREIGN PATENT DOCUMENTS

| | | | |
|---|---|---|---|
| AU | 472333 | | 5/1976 |
| CA | 1131871 | | 9/1982 |
| NL | 6913418 | * | 9/1968 |

OTHER PUBLICATIONS

Search Report—Corresponding PCT Application No. PCT/AU2016/050812, dated Nov. 16, 2016, 6 pages.
(Continued)

*Primary Examiner* — Ryan D Kwiecinski
*Assistant Examiner* — Matthew J Gitlin
(74) *Attorney, Agent, or Firm* — Leber IP Law; Celia H. Leber

(57) ABSTRACT

An interlockerable structural panel (4) with a channel cross-section including a base 3) and first (52) and second side wall (51) forming the sides of the channel, wherein an end of the first side wall distal the base is curved as a first arc (13) directed away from a central portion of the channel and an end of the second side wall is curved as a second arc (23) directed towards the central portion of the channel and wherein a straight section (24) extends from the end of the second arc (23) distal the base (3).

18 Claims, 6 Drawing Sheets

(58) Field of Classification Search
USPC ... 52/86, 518, 519, 520, 521, 588, 536, 542, 52/529, 523, 537, 478, 522, 594
See application file for complete search history.

(56) References Cited

U.S. PATENT DOCUMENTS 3,127,962 A * 4/1964 James ..... E04D 3/362 160/235
3,481,094 A * 12/1969 Taylor ..... E04D 3/366 52/394
4,192,117 A * 3/1980 Heirich ..... E04B 9/363 52/478
4,223,503 A * 9/1980 Hague ..... E04D 3/362 52/394
4,759,159 A 7/1988 Blazley
4,819,398 A 4/1989 Dameron
4,918,898 A * 4/1990 McLeod, Jr. ..... E04F 13/12 52/478
5,241,785 A * 9/1993 Meyer ..... E04D 3/363 52/478
5,524,409 A * 6/1996 Kaiser ..... E04C 2/08 52/537
6,889,478 B1 * 5/2005 Simpson ..... E04C 3/08 52/520
7,574,839 B1 8/2009 Simpson
2003/0014927 A1 * 1/2003 Brooks ..... E04B 1/0046 52/66
2003/0106277 A1 * 6/2003 Heusel ..... E04D 3/362 52/536
2013/0227896 A1 9/2013 Anderson et al.

OTHER PUBLICATIONS

International Preliminary Report on Patentability—Corresponding PCT Application No. PCT/AU2016/050812, dated Oct. 13, 2017, 29 pages.

* cited by examiner

VARIABLE SECTION INTERLOCKING STRUCTURAL PANEL

FIELD OF THE INVENTION

This invention relates to panels which interlock to form self-supporting roofs of buildings, in particular large span roofs supported only by the walls of the building.

BACKGROUND OF THE INVENTION

Interlocking panels for large span roofs have been in use for some time. One of the most successful such panels is disclosed in U.S. Pat. No. 4,759,159 as having a pair of upstanding flanges at opposite longitudinal sides, a male rib supported by one flange and a female rib supported by the other flange, both the male and female ribs extending wholly to one side of their supporting flanges, the male rib engageable with the female rib of an adjacent panel to form an arcuate self supporting roof section for a building.

The female rib is defined as being of generally inverted U-shape form in transverse cross-section having a first leg comprising an extension of said supporting flange and a second leg spaced from said first leg, said second leg having a at its free end, an inwardly directed first deformation and there being provided a second deformation in the region of the junction between said first leg and said supporting flange.

The male rib is defined as being generally of an inverted U-shape form in transverse cross-section having a first leg comprising an extension of said supporting flange and a second leg spaced from said first leg and inclined outwardly away from said first leg, and there being an inwardly directed projection defining a recess in the region of the junction between said first leg and said supporting flange being complementary to said second deformation such that when interlocked said male rib is located within said female rib, said first legs of said male and female ribs are juxtaposed, said second leg of said male rib resiliently engages said second leg of said female rib rearward of said first deformation and said second deformation nests within said recess.

These known panels are formed in longitudinally curved sections and erected and joined to form self supporting roofs as shown in FIG. 1 of the drawings. However the nesting geometry of the inverted U-shapes is quite unforgiving of any deformation of the cross-section of the panel and the male rib tends to spring out of the female rib when the panel is flattened. The common solution to this has been to fasten the female rib to the male rib with screws which defeats the self interlocking of adjoining panels and adds to the cost of construction.

SUMMARY OF THE INVENTION

The present invention provides, an interlocking structural panel including a channel cross-section including a base and first and second side wall forming the sides of the channel, In a first embodiment, the present invention provides, an interlocking structural panel including:

a channel cross-section including a base and first and second side wall forming the sides of the channel;

wherein the first and second side walls include first and second sections;

wherein the first section of the first side wall extends from the base and is angled from the base at from 0° to 45° to the horizontal connecting to the second section of the first side wall;

wherein the second section of the first side wall extends from the first section of the first side wall and is angled at from 30° to 90° to the horizontal and connecting to a third section of the first side wall curving in an arc of from 180° to 330°;

wherein the first section of the second side wall extends from the base and is angled at from 135° to 180° to the horizontal connecting to the second section of the second side wall angled at from 90° to 150° to the horizontal;

wherein the second section of the second side wall connecting to a third section of the second side wall curving in an arc of from 90° to 180°; and wherein connecting to a fourth approximately straight section such that the two latter sections nest inside the said section curving in an arc of from 180° to 330°.

Preferably, the section curving in an arc of from 180° to 330° terminates in a hook section.

Preferably, the channel includes longitudinal depressions.

In a second embodiment, the present invention provides an interlockable structural panel for forming roofs with a channel cross-section including:

a base and first and second side wall forming the sides of the channel;

wherein the first and second side walls mirror each other's extension from the base and provide a generally straight extension from the base;

wherein a region adjoining an end of the first side wall distal the base is curved as a first arc directed away from a central portion of the channel and a section adjoining an end of the second side wall is curved as a second arc directed towards the central portion of the channel;

wherein a straight section extends from the section adjoining the end of the second arc distal the base to form the end of the second side wall;

wherein the end of the first side wall comprises a projection extending towards the first side wall; and preferably, the second arc is arranged to nest within the first arc on an adjacent interlockable structural panel so that the two are locked together.

Preferably, the first side wall includes a first section angled at from 0° to 45° to the horizontal connecting to a second section angled at from 30° to 90° connecting to the first arc.

Preferably, the second side wall includes a third section angled at from 135° to 180° to the horizontal connecting to a fourth section angled at from 90° to 150° connecting to the second arc.

Preferably, the first arc is an arc of between 180° to 330°.

Preferably, the second arc is an arc of between 90° to 180°.

Preferably, the first arc terminates in a hook section.

Preferably, the straight section extending from the second arc in one interlockable structural panel is arranged to engage the ridge of the first side wall on a second interlockable structural panel that the second arc is nested with.

Preferably, the channel has longitudinal depressions.

Preferably, the base of the channel has a waved profile.

Preferably, reinforcing ribs run are located on the side walls.

Preferably, the reinforcing ribs run the length of the panels.

In a third embodiment the present invention provides a roofing section comprising a plurality of the interlockable structural panels wherein the second arc of a first panel is nested into the first arc of an adjacent panel to lock the panels together.

In a third embodiment the present invention provides an interlocking structural panel comprising a plurality of the interlockable structural panels.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

DETAILED DESCRIPTION OF THE INVENTION

Figure 1:
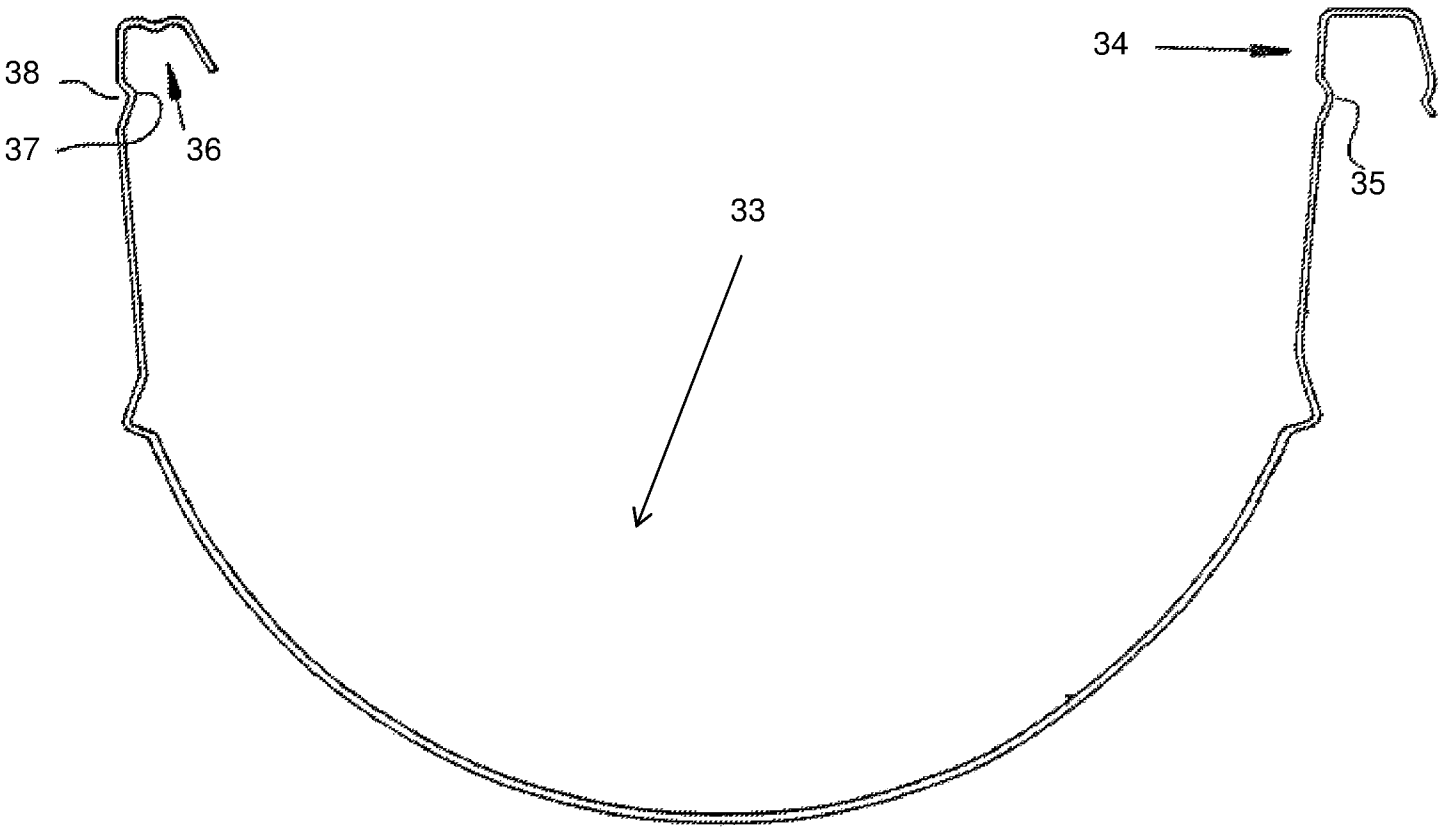
Prior Art Figure 1
FIG. 1 is a cross section of a prior art panel.

With reference to FIG. 1 of the figures, a prior art interlockable building panel 33 is shown. The interlockable building panel 33 includes male rib 36 and female rib 34. The interlockable building panel also includes a first projection 37 proximate the male rib 36 and a second projection 35 proximate the female rib 34. Where adjacent panels 33 are interlocked, the male rib 36 in one panel 33 engages into the female rib 34 in the adjacent panel 33. Additionally, the first projection 37 in one panel 33 nests with the second projection 35 in another panel 33 that the one panel is interlocked with. Due to the U-shaped profiles of the male and female ribs 36, 34, when the two are interlocked there is minimal give for deformation. Therefore, when the panels 33 are flattened the male rib 36 has a tendency to spring out of the female rib 34. The common solution to this has been to fasten the female rib to the male rib with screws which defeats the self interlockable of adjoining panels and adds to the cost of construction.

With reference to FIGS. 2 to 5, interlockable structural panels 4 according to a first embodiment of the present invention are shown. The panels 4 are arranged as channels with a base 3, a first side wall 52 and a second side wall 51 extending from the base 3, both with a component of vertical extension to form the channel. The first and second side walls 52, 51 mirror each other in their generally straight extension from the base. The end of the first side wall 52 is arranged as a first arc 13 that curves away from the centre of the channel and the end of the second wall 51 is arranged as a second arc 23 that curves towards the centre of the channel. Two or more interlockable panels 4 are connected together by nesting the second arc 23 of one interlockable panel 4 into a first arc 13 of an adjacent interlockable panel 4.

The first side wall 52 includes a base extension 1 that extends from the base 3. A first section 11 extends from the base extension 1 at an angle closer to the horizontal than the base extension 1. In one embodiment the first section is at an angle between 0° and 45° to the horizontal. A second section 12 extends from the first section 11 and is at an angle closer to the vertical than the first section 11. In one embodiment the second section is at an angle of between 30° and 90° to the horizontal. The first side wall 52 extends generally straight from the base 3 as illustrated in the Figures.

Extending from the second section 12 is a first arc 13 that is curved away from the center of the channel of panel 4. The end of the arc 13 is arranged as a hook 14 that includes a projection 15 at its distal tip that extends towards the first side wall 52.

In an alternative embodiment the end of the arc 13 includes an alternative arrangement to hook 14 that still projects towards the first side wall 52. This can be a folded straight section or otherwise as understood by the skilled addressee.

The second side wall 51 extends from the base 3 opposite first wall 52. The second side wall 51 includes a second base extension 2. A third section 21 extends from the second base extension 2. In one embodiment the third section is angled from the horizontal between 135° and 180°. A fourth section 22 extends from the third section 21 and is at an angle closer to the vertical than the third section 21. In one embodiment the fourth section is at an angle of between 90° and 150° to the horizontal. The second side wall 51 extends generally straight from the base 3 as illustrated in the Figures.

Extending from the fourth section 22 is a second arc 23 that is curved towards the center of the channel of panel 4. The end of the arc 23 is arranged as a straight section 24 running approximately parallel to the fourth section 22. The straight section 24 is of a length to be received within the first arc 13. The end of the straight section 24 is arranged to abut and be restrained by the projection 15 of the hook 14 at the end of arc 13 when the second arc 23 is nested into a first arc 13 of an adjacent panel 4.

Figure 3:
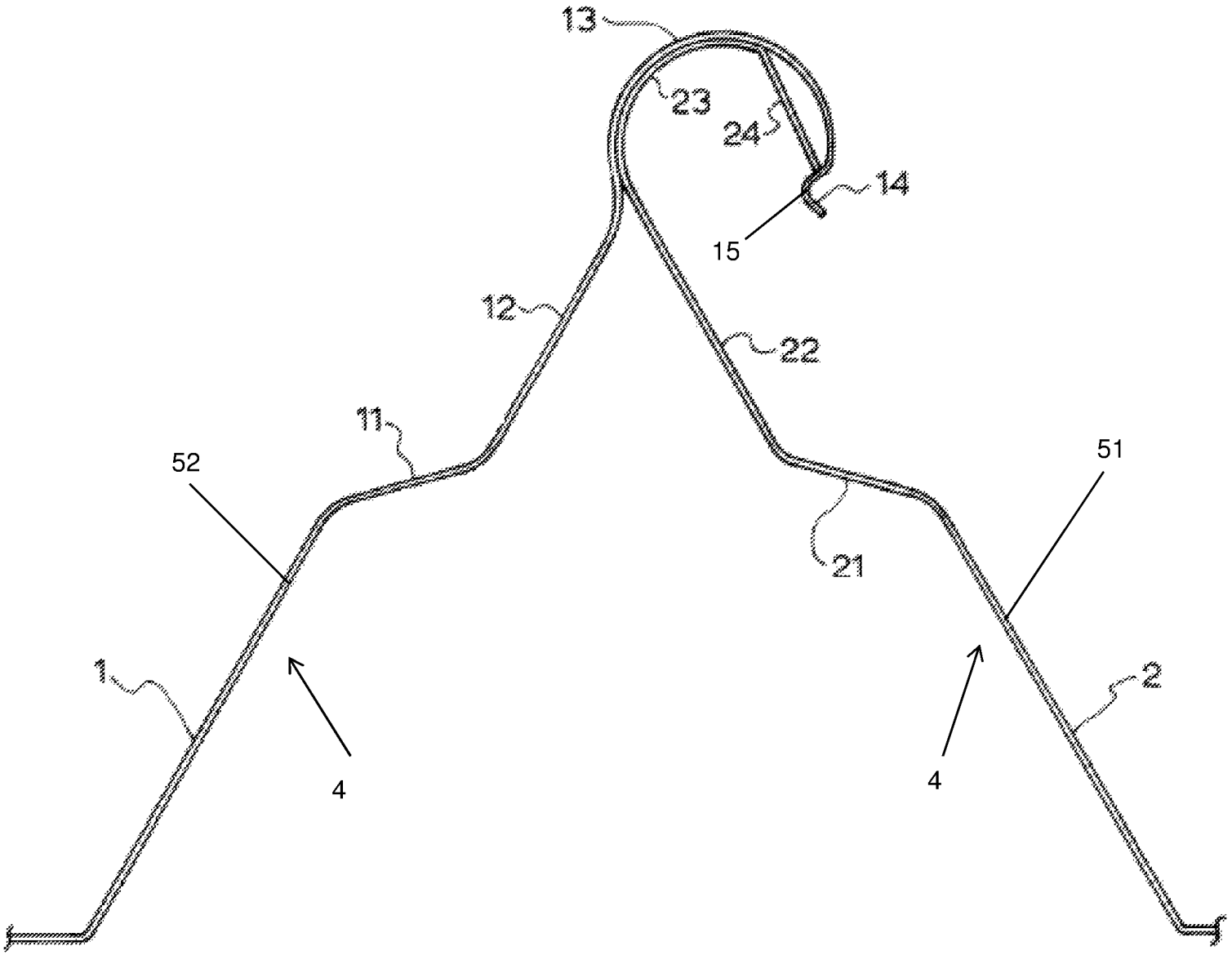
FIG. 3 is a sectional cross-section of the joining of the interlocking building panels of FIG. 2.

FIG. 3 illustrates the joining of one interlockable panel 4 with another. Arc 23 of second side wall 51 nests inside arc 13 of the first side wall 52. The straight section 24 extends and its end is retrained from rotating by the projection 15 of the hook 14. Arc 13 acts as a female mating section to receive arc 23. As detailed in FIGS. 3 and 5, first side wall 52 is formed with first section 11 extending form the base extension, the first section 11 is angled at 15° to the horizontal connecting to a further section 12 angled at 60° to the horizontal and connecting to a section 13 curving in an arc of 270°. Section 13 terminates in a hook section 14.

Also as detailed in FIG. 3, second side wall 51 is formed with third section 21 21 angled at 165° to the horizontal connecting to fourth section 22 angled at 120° to the horizontal and connecting to a section 23 curving in an arc of 130°. Section 23 connects to a straight section 24 such that sections 23 and 24 nest inside section 13 of leg 1.

Figure 5:
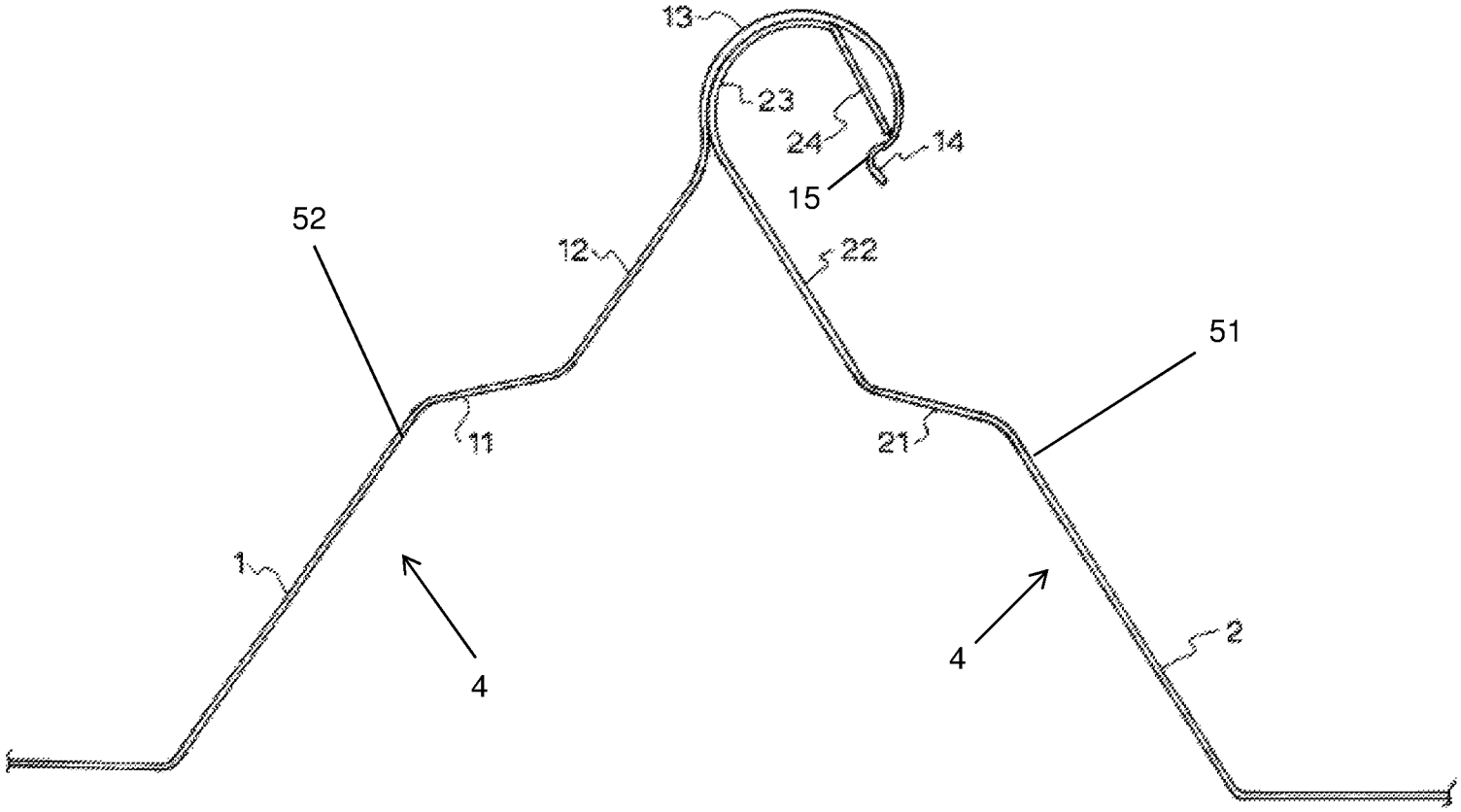
FIG. 5 is a cross-section of the joining of adjacent panels flattened as in FIG. 3.

FIG. 5 shows a panel in which the channel profile of panel 4 has been flattened to provide greater horizontal coverage. This is particularly advantageous for roofs where the span admits of self supporting panels where a lesser second moment of bending is adequate. The second moment of bending is proportional to the square of the depth of the channel. The latter may be strengthened by pressing longitudinal depressions into the sheet material.

Figure 4:
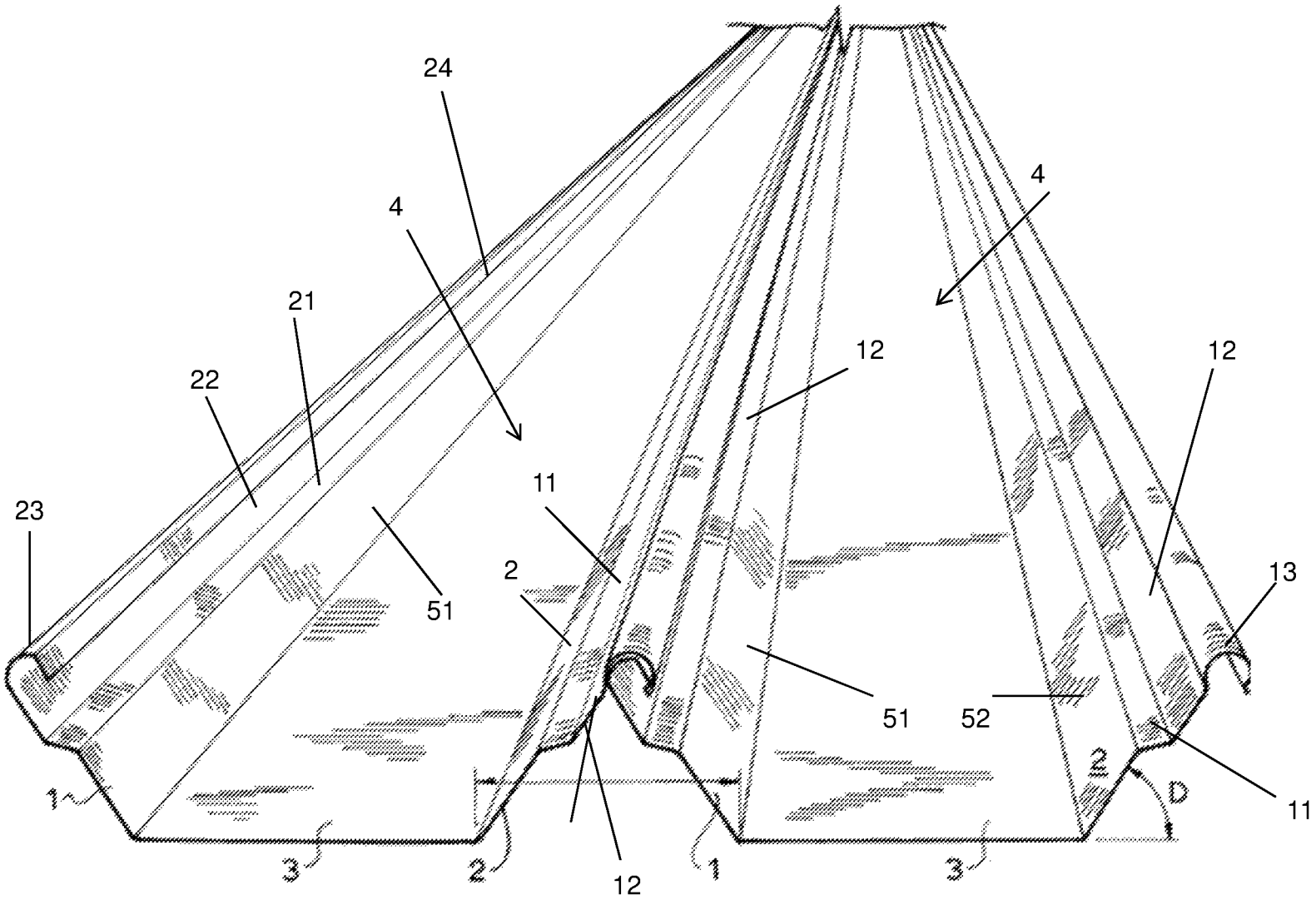
FIG. 4 is a perspective of the flattened interlocking building panels of FIG. 2.

FIG. 4 shows how the joint geometry of first and second side walls 52, 51 accommodates the flattening of first and second side walls 52, 51 with the integral nesting of sections 23 and 24 inside section 13 being maintained. Accordingly the integrity of the joint minimizes the need for fasteners which are required in prior art panels. As the second side wall 51 flexes and arc 23 attempts to rotate, the straight section hits the projection 15 of the hook 14 and is restrained from rotating and slipping out of arc 13.

Figure 2:
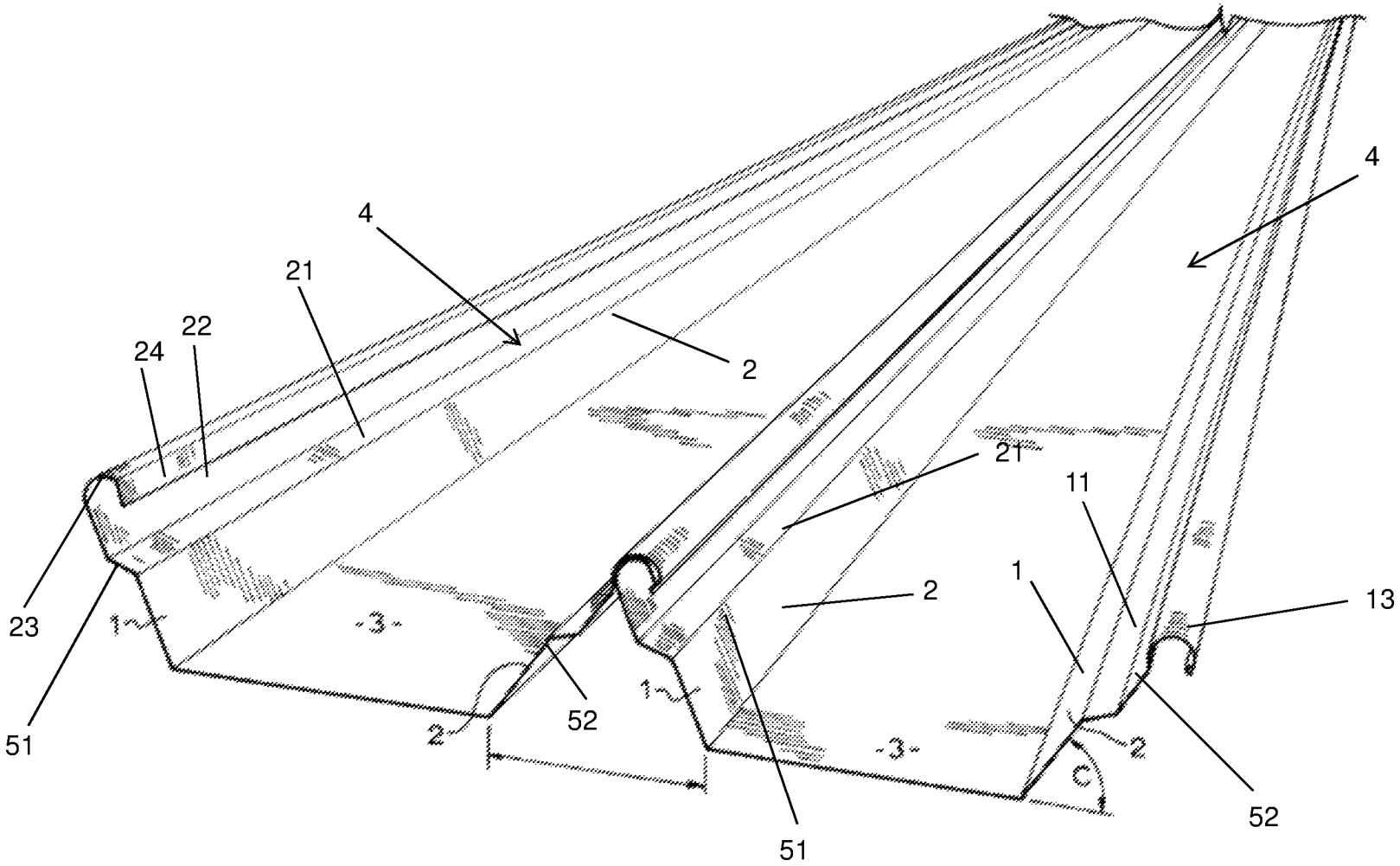
FIG. 2 is a perspective of a single panel with normal cross-section of interlocking building panels according to a first embodiment of the present invention.

FIGS. 2 and 4 show the interlockable panels 4 interlocked to form a single roof section.

Figure 6:
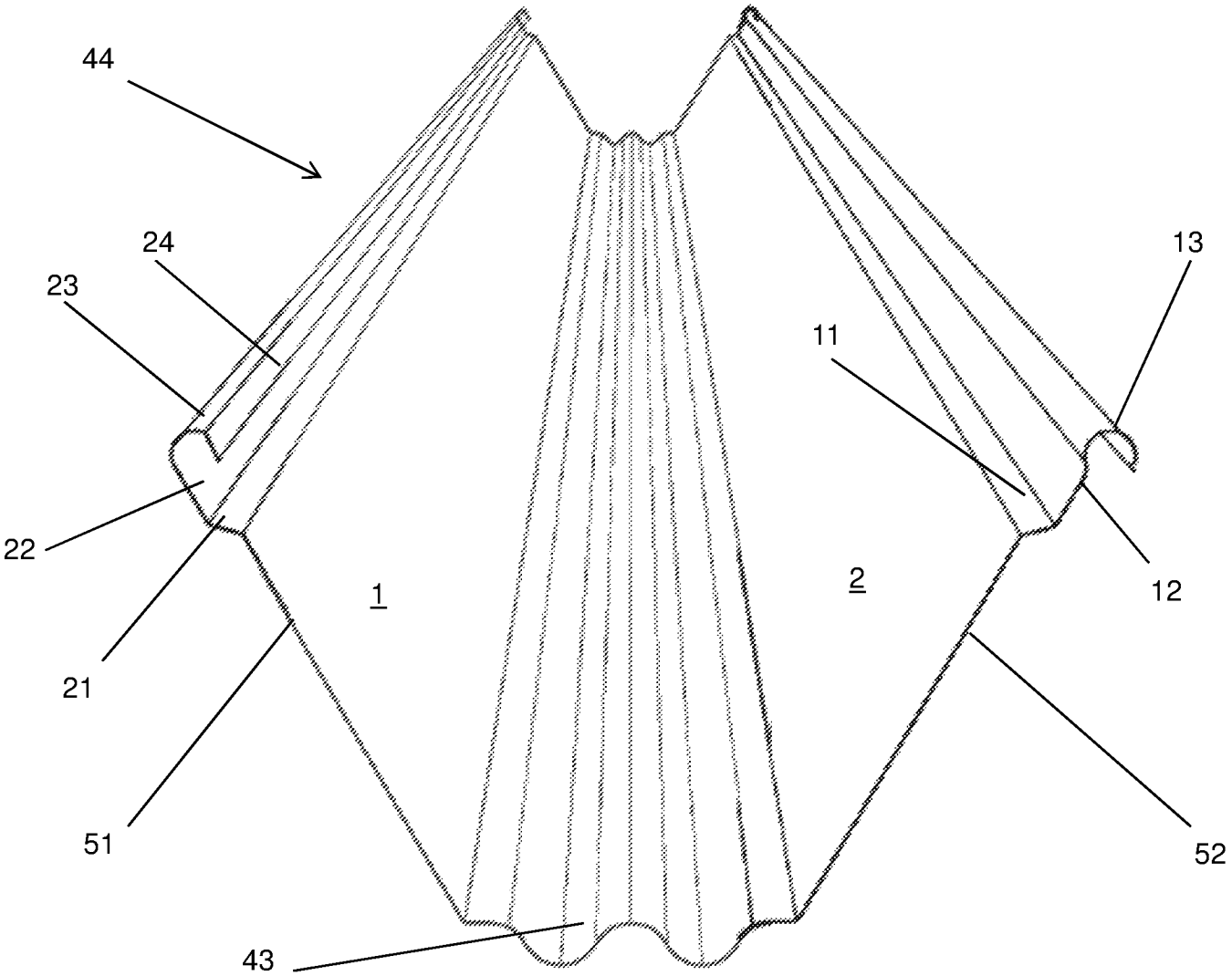
FIG. 6 is a perspective view of a single panel with normal cross-section of interlocking building panels according to a second embodiment of the present invention.

With reference to FIG. 6 a second embodiment of the present invention is shown. For convenience features of the interlockerable interlockable panel 44 that are similar or correspond to features of the panel 4 of the first embodiment have been referenced with the same reference numerals.

Interlockable panel 44 includes a base 43 in place of base 4 for panel 4. The base 43 is of a waved profile to strengthen the base 43.

In an alternative embodiment, ridges or fluting runs along the length of the first and second side walls for reinforcement. The ridges or fluting can be located along the first or second base extensions 1, 2, or the second or fourth sections 12, 22.

VARIATIONS AND MODIFICATIONS

It will be realized that the foregoing has been given by way of illustrative example only and that all other modifications and variations as would be apparent to persons skilled in the art are deemed to fall within the broad scope and ambit of the invention as herein set forth.

It will be realised that the foregoing has been given by way of illustrative example only and that all other modifications and variations as would be apparent to persons skilled in the art are deemed to fall within the broad scope and ambit of the invention as herein set forth.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. The invention is intended to embrace all alternatives, modifications, and variations of the present invention that have been discussed herein, and other embodiments that fall within the scope of the above described invention.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The invention claimed is:

1. An interlockable structural panel for forming roofs with a channel cross-section including:

a base and first and second side walls forming the sides of the channel; wherein the first and second side walls mirror each other's extension from the base and provide a generally straight extension from the base;

wherein a region adjoining an end of the first side wall distal the base is curved as a first arc directed away from a central portion of the channel and a section adjoining an end of the second side wall is curved as a second arc directed towards the central portion of the channel;

wherein a straight section extends from a distal end of the second arc, the straight section being approximately parallel to the second side wall;

wherein the end of the first arc comprises a projection, a distal tip of the projection extending towards the first side wall; and wherein the entire length of the first arc and the entire length of the second arc with the straight section define mateable portions arranged to engage with identical first and second arcs of an adjacent identical structural panel in a locking manner without deforming the first or second arcs or the straight section.

2. The interlockable structural panel as claimed in claim 1, wherein the second arc is arranged to nest within the first arc on an adjacent interlockable structural panel so that the two are locked together.

3. The interlockable structural panel as claimed in claim 1, wherein the first side wall includes a first section angled at from 0° to 45° to the horizontal connecting to a second section angled at from 30° to 90° connecting to the first arc.

4. The interlockable structural panel as claimed in claim 2, wherein the second side wall includes a third section angled at from 135° to 180° to the horizontal connecting to a fourth section angled at from 90° to 150° connecting to the second arc.

5. The interlockable structural panel as claimed in claim 1, wherein the first arc is an arc of between 180° to 330°.

6. The interlockable structural panel as claimed in claim 1, wherein the second arc is an arc of between 90° to 180°.

7. The interlockable structural panel as claimed in claim 1, wherein the first arc terminates in a hook section.

8. The interlockable structural panel as claimed in claim 7, wherein the straight section extending from the second arc in one interlockable structural panel is arranged to engage the projection of the first side wall on a second interlockable structural panel that the second arc is nested with.

9. The interlockable structural panel as claimed in claim 7, wherein the straight section terminates in an end that is configured to abut and be restrained from rotating by the hook when the second arc is nested into the first arc of an adjacent panel.

10. The interlockable structural panel as claimed in claim 1, wherein the channel has longitudinal depressions.

11. The interlockable structural panel as claimed in claim 1, wherein base of the channel has a waved profile.

12. The interlockable structural panel as claimed in claim 1, wherein reinforcing ribs-are located on the side walls.

13. The interlockable structural panel as claimed in claim 12, wherein the reinforcing ribs run the length of the panels.

14. A roofing section comprising a plurality of the interlockable structural panel of claim 1, wherein the second arc of a first panel is nested into the first arc of an adjacent panel to lock the panels together.

15. The interlockable structural panel as claimed in claim 1, wherein the length of the straight section is configured to be received within and extend across the first arc of an adjacent panel.

16. An interlockable structural panel for forming roofs with a channel cross-section including:

a base and first and second side walls forming the sides of the channel;

wherein the first and second side walls mirror each other's extension from the base and provide a generally straight extension from the base;

wherein a region adjoining an end of the first side wall distal the base is curved as a first arc directed away from a central portion of the channel and a section adjoining an end of the second side wall is curved as a second arc directed towards the central portion of the channel;

wherein a straight section extends from a distal end of the second arc, the straight section being approximately parallel to the second side wall; and wherein the entire length of the first arc and the entire length of the second arc with the straight section define mateable portions arranged to engage with identical first and second arcs of an adjacent identical structural panel in a locking manner without deforming the first or second arcs or the straight section.

17. The interlockable structural panel as claimed in claim 16, wherein the first arc terminates in a hook and the straight section terminates in an end that is configured to abut and be restrained from rotating by the hook when the second arc is nested into the first arc of an adjacent panel.

18. The interlockable structural panel as claimed in claim 16, wherein the length of the straight section is configured to be received within and extend across the first arc of an adjacent panel.

* * * * *